US005092382A

United States Patent [19]

Flückiger

[11] Patent Number: 5,092,382

[45] Date of Patent: Mar. 3, 1992

[54] APPARATUS FOR RAISING AND LOWERING A WINDOW BLIND

[75] Inventor: Werner Flückiger, Muensingen, Switzerland

[73] Assignee: K. Bratschi, Silent Gliss, Muri near Bern, Switzerland

[21] Appl. No.: 397,478

[22] PCT Filed: Nov. 16, 1988

[86] PCT No.: PCT/CH88/00211

§ 371 Date: Aug. 14, 1989

§ 102(e) Date: Aug. 14, 1989

[87] PCT Pub. No.: WO89/05603

PCT Pub. Date: Jun. 29, 1989

[30] Foreign Application Priority Data

Dec. 15, 1987 [CH] Switzerland ..... 4884/87-6

[51] Int. Cl.[5] ..... A47H 5/032

[52] U.S. Cl. ..... 160/84.1; 160/170

[58] Field of Search ..... 160/84.1, 170, 171, 160/321

[56] References Cited

U.S. PATENT DOCUMENTS

| | | | |
|---|---|---|---|
| 1,084,781 | 1/1914 | Behrle | 160/84.1 |
| 2,676,654 | 4/1954 | Vallen | 160/84.1 X |
| 3,844,330 | 10/1974 | Hyman | 160/84.1 X |
| 4,518,025 | 5/1985 | Judkins | 160/84.1 |
| 4,610,290 | 9/1986 | Dorflinger | 160/84.1 |
| 4,850,415 | 7/1989 | Rometsch | 160/84.1 |
| 4,901,419 | 2/1990 | Voss | 160/84.1 X |

FOREIGN PATENT DOCUMENTS

| | | | |
|---|---|---|---|
| 0058459 | 8/1982 | European Pat. Off. | 160/84.1 |
| 0162025 | 11/1985 | European Pat. Off. | 160/84.1 |

*Primary Examiner*—David M. Purol
*Attorney, Agent, or Firm*—Weiser & Stapler

[57] ABSTRACT

An apparatus which facilitates the raising and lowering of a pull-up band for a blind. An axially rotatable winding shaft is disposed generally parallel to the section rail by which the apparatus is attached to a wall. At least one winding roller is disposed along the winding shaft, having an axis of rotation extending generally horizontally and perpendicular to the winding shaft, and is adapted to extend and retract a pull-up band wound onto the winding roller responsive to a drive mechanism which transfers motion from the winding shaft to the winding roller. The winding roller is rotatably mounted in a holder, and the drive mechanism is housed in a housing which is detachably fastened to the section rail.

11 Claims, 2 Drawing Sheets

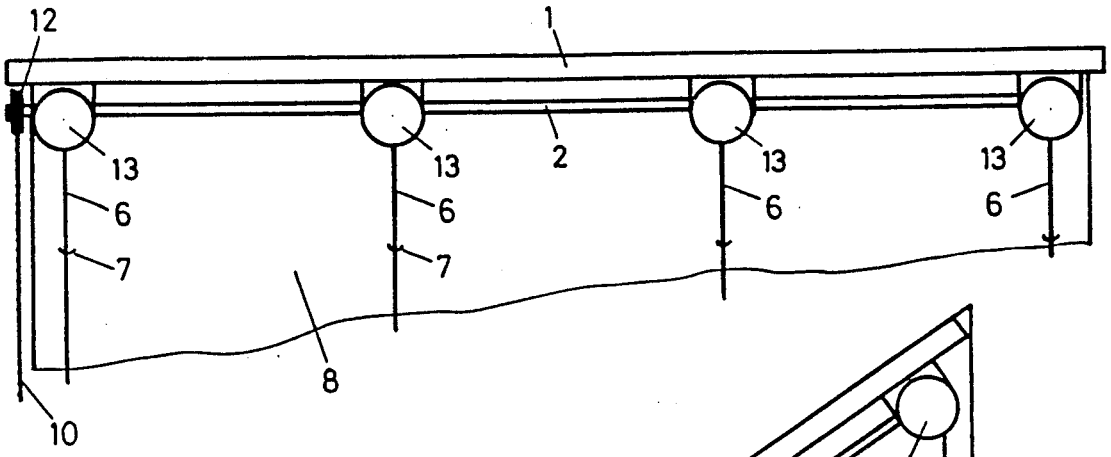
Fig. 1
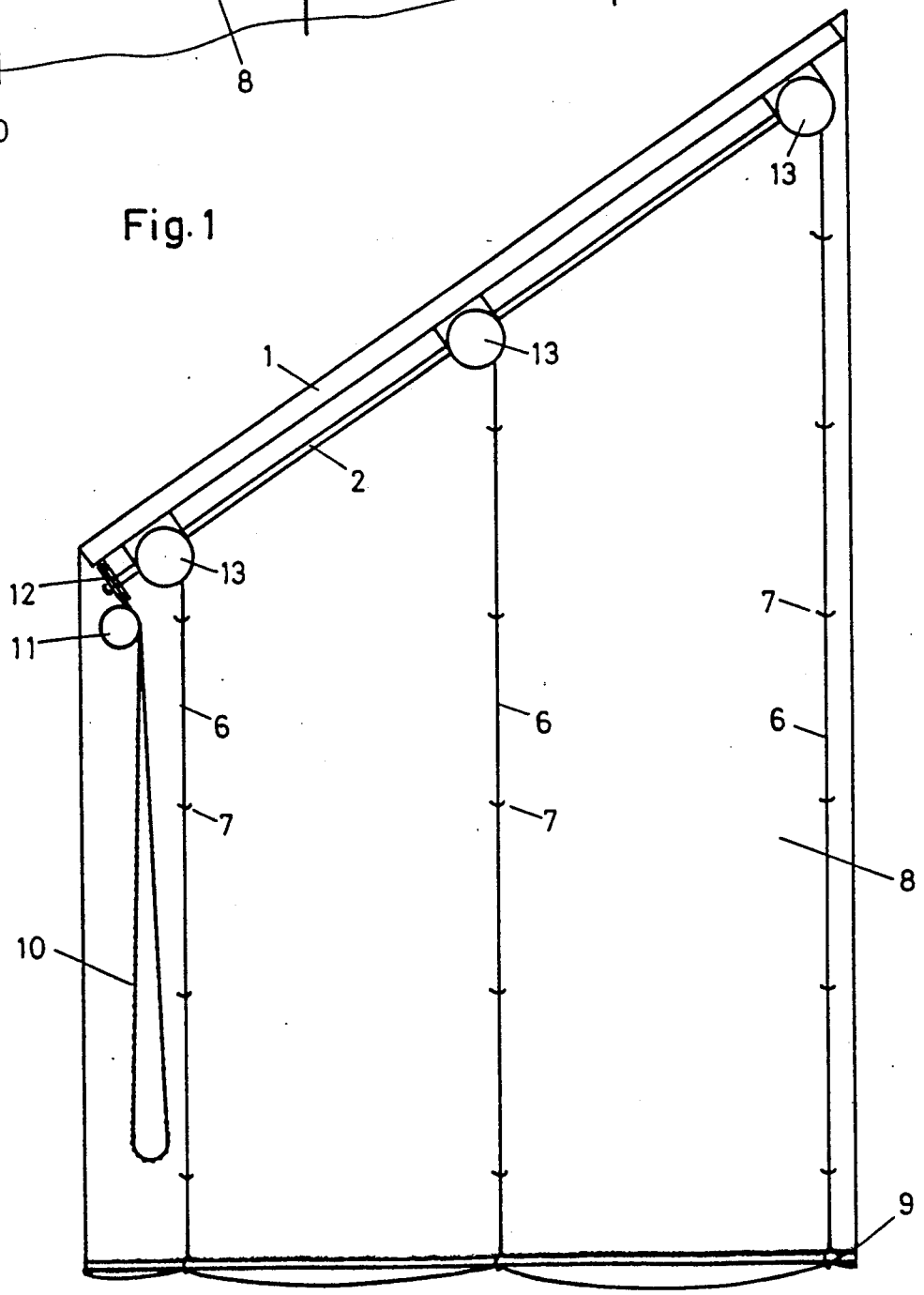

III
IV

APPARATUS FOR RAISING AND LOWERING A WINDOW BLIND

BACKGROUND OF THE INVENTION

1. Field of the Invention

The present invention pertains to blinds for windows or other uses, and particularly, to blinds which are raised and lowered by means of one or more pull-up bands.

2. Description of the Prior Art

Such blinds are disclosed in the state of the art by U.S. Pat. No. A-2,676,654. In these blinds, the winding rollers are firmly connected to the winding shaft without axial play, and a separate bracket, which is fastened to the wall, is arranged next to each winding roller.

Blinds of this type, in which the winding rollers are displaceable in the axial direction of the winding shaft with an axial play and in which each winding roller is also equipped with a bracket as well as with an adjusting ring, are disclosed in EP-A-0,118,700.

These blinds have the disadvantages that they cannot be used for slanted windows, in which the winding shaft is arranged obliquely, and the winding rollers can only hold about 3 m of cord because of limited space behind the blinds.

The basic task of the present invention is to create blinds of the above-described type, which avoid these disadvantages and yet can be installed simply and are reliable in operation.

SUMMARY OF THE INVENTION

The task is accomplished by an improved apparatus for raising and lowering the pull-up band for a blind. An axially rotatable winding shaft is disposed generally parallel to a section rail, which may be attached, for example, to a wall above a window. At least one winding roller is disposed along the winding shaft, the winding roller having an axis of rotation extending generally horizontally and perpendicular to the winding shaft. The winding roller is adapted to extend and retract a pull-up band wound onto the winding roller. Drive means permit the transference of motion from the winding shaft to the winding roller. The winding roller is rotatably mounted within a holder, and a housing detachably fastened to the section rail encloses the drive means.

Even if the winding shaft is in a markedly oblique position, pull cords and pull bands are satisfactorily wound up without rubbing, for which reason the blinds according to the present invention are also suitable for slanted windows. The diameter is not limited to the distance between the blinds and the window and may be substantially greater, and the blinds can be correspondingly longer. Damage to the blinds due to tangential rubbing on the winding rollers is avoided according to the present invention. Separate brackets can be dispensed with, which substantially simplifies the installation and stocking of parts.

One variant of the invention includes a self-locking worm drive, which creates a simple braking mechanism, by which the blinds are automatically stopped in any desired intermediate position.

In an other variant of the invention, the worm-drive is of a suitable transmission ratio so that an additional braking mechanism is unnecessary and with which even heavy blinds can be pulled up with little force due to the transmission ratio of the worm drive.

High unwinding velocity and destruction of the winding mechanism, of the control member or of the blinds as a consequence of the rapid deceleration of the mass are avoided. Accidents with the blinds due to a weight section rushing down at high speed may also not occur according to the present invention.

Invention prevents the pull-up member from being caught during winding up or down, and it permits a simple installation.

In the preferred embodiment a self-locking worm drive is arranged between the drive member and the winding shaft. The drives between the winding rollers and the winding shaft can be ordinary, inexpensive drives without self-locking mechanism. A drive wheel is preferably mounted such that an arrangement similar to the winding rollers is obtained.

Embodiments of the present invention are explained in greater detail below on the basis of the drawings.

BRIEF DESCRIPTION OF THE DRAWINGS

FIG. 1 shows installed blinds for a slanted window and blinds for an ordinary window.

DETAILED DESCRIPTION OF THE INVENTION

Figures 2, 3, 4:
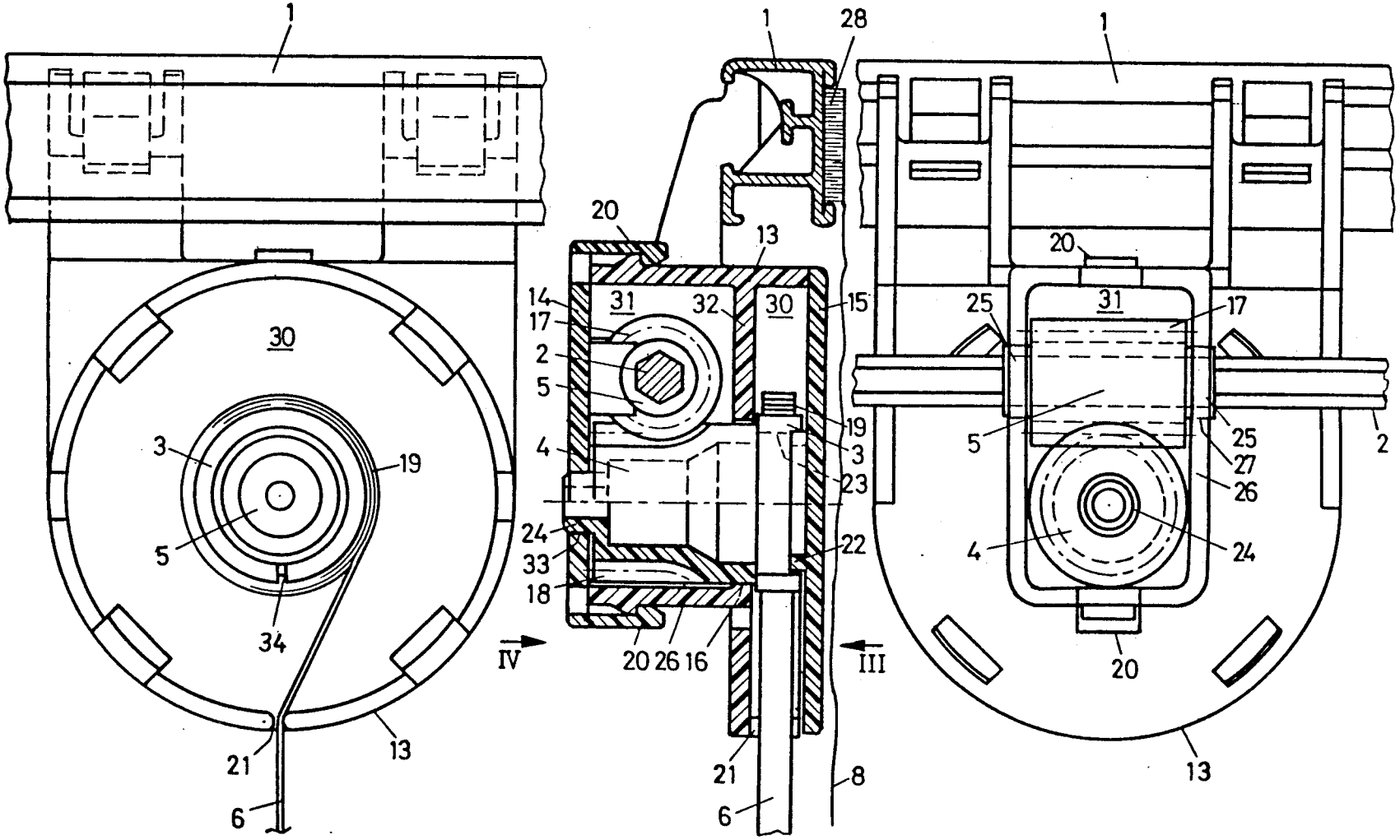
FIG. 2 shows a section through a holder attached to a section bar with drive and winding wheel.
FIG. 3 shows a view of a part of the holder with the drive and winding roller installed in the direction of arrow III in FIG. 2.
FIG. 4 shows a view of the part according to FIG. 3 in the direction of arrow IV in FIG. 2.

FIG. 1 shows vertically hanging blinds 8 to which a weight section 9 is attached. A multiplicity of pull-up bands 6 arranged at spaced locations and parallel to one another are wedged in a slot 34 of the winding roller 3 at one end (FIG. 3) and are attached to the weight section 9 at the other end (FIG. 2). Between their ends, the pull-up bands 6 are guided in eyelets 7 which are fastened to the blinds 8 and by which the pull-up bands 6 are pulled through displaceably with ease.

The axes of the winding rollers 3 are arranged horizontally and at right angles to a winding shaft 2, which is connected to a drive wheel 12 that can be driven by a bead chain. The winding shaft 2 is arranged horizontally in the case of an ordinary window and it is sloped in the case of blinds for a slanted window. A blind rail 1 extends in parallel to the winding shaft 2 and is fastened, in the usual manner, to the ceiling, the wall or the window. As is shown in FIG. 2, the blinds 8 are detachably fastened to this blind rail 1 by means of a nap or warp band 28. To operate the blinds, the bead chain 10 is pulled; a guide roller 11 is arranged under the drive wheel 12 in the case of blinds intended for a slanted window. In one direction of pull of the endless bead chain 10, the pull-up bands 6 are wound up on the winding rollers 3 and the blinds are pulled up, while in the other direction of pull, the pull-up bands 6 are wound off synchronously and the blinds are lowered. As is explained below, the blinds automatically stop immediately on letting the bead chain go.

As is shown in FIGS. 2 through 4, each of the winding rollers 3 are mounted in a housing, which essentially consists of a housing body 13 and two covers 14 and 15 that are placed on the said housing body. Two clamps 40 are molded at spaced locations on top of the housing body 13, and these clamps 40 are inserted into the blind rail 1 such that they are detachable and displaceable in the longitudinal direction.

The housing body 13 has a vertical wall 32 which subdivides the housing into two chambers 30 and 31. The winding roller 3 with the wound-up band 19 is housed in the chamber 30. The lower part of the chamber 30 has a narrow slot 21, in which the pull-up band 6 is guided. This slot 21 prevents the band 6 from twisting in the chamber 30, and it prevents disturbances during the formation of the wound-up hand 19. The chamber 30 also has a detachably mounted cover 15, which on the inside has a projection 22 reaching into and guiding the winding roller 3. The winding roller 3 is molded on a worm gear 4 which is mounted in an opening 16 of the wall 32 and with a pin 24 in an opening 33 of another cover 14. The teeth 18 of the worm gear 4 mesh with a worm 5 which is mounted on the housing part 13 and on the cover 14. The worm wheel 5 is connected to the winding shaft 2 nonrotatably and longitudinally displaceably. It is often necessary to tension or slightly loosen a wound-up hand 19 so that all the bands 6 pull up the blinds 8 synchronously. This can be achieved simply by removing the worm gear 4 from the chamber 31 after removal of the cover 15 at the winding roller 3 and rotating it in the uncoupled state in one direction or another, thus adjusting the slot 34.

Consequently, the above description discloses blinds which have a relatively small number of components, which are also robust and simple, despite the substantial advantages, and which excellently meet practical requirements, including very gentle treatment of the blinds when used for a slanted window or for very tall windows and which nevertheless can be easily manufactured and are highly reliable in operation.

The transmission ratio of the worm drive is selected to be such that the pull-up mechanism is self-locking, and the friction of the moving parts is taken into account. If the worm 5 is made of nylon and the worm gear 4 is made of Delrin, self-locking is possible at a transmission ratio of 1:4.2. Without friction, the transmission ratio would have to be about 1:6 for self-locking to occur. It was found that a transmission ratio of about 1:4 is advantageous for blinds. On the one hand, even heavy blinds can be operated with a low force, and on the other hand, the transmission ratio is not yet high enough to cause the blinds to move too slowly. Self-locking causes the blinds to stop immediately in any intermediate position reached on letting the bead chain go. This prevents, in particular, the weight section 9 from rushing down and causing personal injury or damaging the blinds when the bead chain 10 is accidentally let go.

The cover 14 is detachably fastened to the housing body 13 by means of a snap-in mechanism 20. The cover 15 is also attached to the housing body 13 with a similar snap-in mechanism. As is apparent, the winding roller 3 is enclosed in the housing and there are no rotating parts that would come into contact with the blinds and damage it. Since the housing body 13 is infinitely displaceable on the winding shaft 2, it is always possible to bring the slot 21 exactly in line with the eyelets 7. The housing body 13 can subsequently be fastened to the blind rail 1 in the position selected. If the drive wheel 12 is connected to the winding shaft via a self-locking worm drive, it is not necessary that the worm drives 4, 5 be self-locking. The drive wheel 12 is preferably similar to a winding roller mounted with its axis of rotation at right angles to the winding shaft on the rail 1 in a housing.

I claim:

1. Apparatus for raising and lowering a pull-up band for a blind, comprising:
   - a section rail;
   - an axially rotatable winding shaft, disposed generally parallel to the section rail;
   - at least one winding roller disposed along the winding shaft, having an axis of rotation extending generally horizontally and perpendicular to the winding shaft, and adapted to extend and retract a pull-up band wound thereon, each roller having associated therewith:
     - drive means for transmitting motion from the winding shaft to the winding roller; and
     - a housing for rotatably mounting the winding roller, detachably fastened to the section rail and substantially enclosing the drive means;
     - wherein the drive means is a worm drive, including a worm associated with the winding shaft and a worm gear associated with the winding roller.

2. Apparatus as in claim 1, wherein the housing further includes a front cover and a back cover for substantially fully enclosing the drive means.

3. Apparatus as in claim 1, comprising a plurality of winding rollers disposed along the winding shaft.

4. Apparatus as in claim 1, wherein the drive means is self-locking.

5. Apparatus as in claim 1, wherein the worm and the worm gear combine in a transmission ratio which provides self-locking of the winding roller.

6. Apparatus as in claim 5, wherein the worm is made of nylon, and the worm gear is made of Delrin.

7. Apparatus as in claim 5, wherein the transmission ratio from the winding shaft to the winding roller is not less than 3:1 and not more than 5:1.

8. Apparatus as in claim 7, wherein the transmission ratio is 4.2:1.

9. Apparatus as in claim 1, wherein the housing is divided into first and second chambers, the first chamber substantially enclosing the worm, and the second chamber substantially enclosing the winding roller.

10. Apparatus as in claim 9, wherein the second chamber is closed by a cover, and the cover includes a projection on an inside surface thereof, for guiding the pull-up band onto the winding roller.

11. Apparatus as in claim 1, wherein the winding roller is molded integral with the worm gear.

* * * * *